US006612509B2

(12) United States Patent
Holmström

(10) Patent No.: US 6,612,509 B2
(45) Date of Patent: Sep. 2, 2003

(54) SEALING NOZZLE

(75) Inventor: Michael Holmström, Finja (SE)

(73) Assignee: EFTEC European Holding, AG

( * ) Notice: Subject to any disclaimer, the term of this patent is extended or adjusted under 35 U.S.C. 154(b) by 0 days.

(21) Appl. No.: 09/879,245

(22) Filed: Jun. 8, 2001

(65) Prior Publication Data

US 2002/0014544 A1 Feb. 7, 2002

(51) Int. Cl.[7] ..... B05B 1/00

(52) U.S. Cl. ..... 239/589; 239/568; 239/597; 239/599; 239/601

(58) Field of Search ..... 239/568, 589, 239/597, 599, 601

(56) References Cited

U.S. PATENT DOCUMENTS

| | | | | |
|---|---|---|---|---|
| 1,743,443 A | | 4/1930 | Murray | |
| 1,902,987 A | * | 3/1933 | Bell | 239/601 |
| 2,204,802 A | * | 6/1940 | Gessler | 239/568 |
| 2,325,008 A | | 7/1943 | Gruett | 299/153 |
| 3,659,787 A | * | 5/1972 | Ito | 239/601 |
| 3,836,076 A | | 9/1974 | Conrad et al. | 239/8 |
| 4,095,674 A | * | 6/1978 | Kido et al. | 239/601 |
| 4,097,000 A | * | 6/1978 | Derr | 239/601 |
| 4,459,029 A | | 7/1984 | Veyriere | 366/179 |
| 4,618,101 A | * | 10/1986 | Piggott | 239/589 |
| 5,052,624 A | * | 10/1991 | Boers et al. | 239/599 |
| 6,019,298 A | * | 2/2000 | Raghavan et al. | 239/599 |

FOREIGN PATENT DOCUMENTS

| | | |
|---|---|---|
| DE | 753996 | 4/1933 |
| GB | 1 270 133 | 7/1969 |
| GB | 2 192 354 | 3/1987 |

* cited by examiner

*Primary Examiner*—Robin O. Evans
(74) *Attorney, Agent, or Firm*—Boyle Fredrickson Newholm Stein & Gratz S.C.

(57) ABSTRACT

The present invention relates to a nozzle intended for the application of fluid materials, which at a front end thereof has an aperture opening into a slot. A central portion of the slot is functioning to release most of the material straight ahead. Furthermore, the slot has side portions functioning to release material in sideway directions. In a preferred embodiment, the front end is shaped like a truncated cone with a flat top, in which the slot is formed. The slot is thus divided into three straight portions with the central portion in the flat top and the angle of the side portions defined by the top angle of said cone. Under certain conditions, the jets of material released from the various portions are held together by a surface tension. As most of the material is released from the central portion, the jets from the angled side portions will be deflected towards the center jet, resulting in a jet with a relatively even width, and a resultant coating being thickest in the middle.

23 Claims, 2 Drawing Sheets

SEALING NOZZLE

FIELD OF THE INVENTION

The present invention relates to a technique for application, via a nozzle, of fluid materials in a controlled manner. More particularly, the invention relates to a nozzle for the application of a sealant or a glue, e.g. onto the joints of car bodies.

BACKGROUND

In assemblies comprising sheet metal work, there will typically be joints. These joints will occur e.g. where two or more pieces of sheet metal are joined with a certain overlap. Various techniques for joining sheet metal components are e.g. welding, riveting or gluing. For various reasons, not least cost reasons, spot welding is often used. This means that the sheets are joined by discrete spot welds, spaced along the joint. The joint then achieved, in the form of spot welds, will thus exhibit a certain similarity to a riveted seam or joint. Overlapping joints between plates joined together could provide a source of corrosion damage, as moisture might be drawn into the joint by capillary forces. Consequently, is often desirable to seal the joint with some water-resistant material, especially for sheet metal constructions to be used in outdoor applications.

A typical example where the above technique is utilised, is the design of car bodies. A car body typically consists of a multitude of sheet metal parts, joined through spot welding. Most of these joints between such sheet metal parts are, in the finished car, hidden from view behind panels, seats, etc. In order to protect these joints from corrosion caused by e.g. condensation, a sealant is usually applied onto the overlapping joint. Similar to the welding itself, the sealant application is normally performed by robots, spraying on the sealant through nozzles. The robot will follow the welded seam and apply sealant onto the joint, and it is desirable for the sealant to cover the joint with an overlap that is appropriate for the application. There is however no need for applying any sealant far beside the joint.

An important factor when applying the sealant is how well the robot can follow edges and bends in the joint; a car does not consist of many straight weld joints. This may be achieved by the robot following a predetermined, computer-stored movement pattern, corresponding to the layout of the weld seams of the body. One problem with such a technique is, however, that the dimensional accuracy in a car body is typically a couple of millimeters. Thus, a certain flexibility is demanded of the robot, and especially of its nozzle, allowing a satisfactory application of the sealant onto the joint, in spite of the nozzle being somewhat closer to, or somewhat further away from, the joint than assumed by the robot. Another way of resolving the problem of making the robot follow the weld seams is to provide it with a distance sensor in association with the nozzle, or alternatively, with some type of sensing means, trailing the sheet metal and thus sensing the actual distance from the robot nozzle to the joint. Such systems may however have other disadvantages, such as a higher cost, but also by occupying space in the robot head.

FIG. 1 illustrates a prior art nozzle, used for the application of sealant onto sheet metal joints. The nozzle is characterised by its aperture being a slot in a curved portion. As is also illustrated in the figure, the material supplied via the nozzle passage will leave the slot in a generally radial direction, from the core portion. The material will thus be sprayed in a flat cone configuration, which is also a common denomination for this type of nozzle (flat cone). This spraying technique will provide a relatively even thickness of sealant material over the joint portion. The thickness as well as the width of the applied sealant material will however be directly dependent on the distance between the nozzle and the substrate; a longer distance will provide a thinner coating over a wider area. Should the application distance increase above a certain value, the jet might be split into smaller jets in an uncontrolled manner.

Another type of prior art nozzle is shown in FIG. 2. This nozzle is similar to that of oil burners and has an interior chamber where a vortex is formed when the material is extruded. The nozzle opening may also be threaded, in order to enhance the vortex movement. When the material is ejected, the jet will have the form of a hollow cone or comet, as illustrated in the figure. As the jet is conical, this nozzle exhibits the same distance sensitivity as the nozzle discussed in connection with FIG. 1. Furthermore, as the nozzle is passed along a joint, the coating will be thicker along the sides than in the middle, where the material is best needed.

OBJECT OF THE INVENTION

The object of the present invention is to provide a nozzle overcoming the described disadvantages of the prior art. More particularly, it is an object of the present invention to provide a nozzle for application of a coating, e.g. a sealant, so constituted as to be less sensitive to the distance between said nozzle and the surface onto which the coating is to be applied, than prior art nozzles. It is a further object of the present invention to provide a nozzle that is functioning to distribute the material, over the application surface covered, in such a way that an improved sealing is provided with a given amount of material, compared to the prior art.

SUMMARY OF THE INVENTION

The present invention relates to a nozzle, intended for the application of fluid materials, which at a front end thereof has an aperture which opens into a slot. A central portion of said slot is intended to release most of the material straight ahead. Furthermore, the slot has side portions functioning to release material in sideways directions. In a preferred embodiment, said front end is shaped like a truncated cone with a flat top, in which said slot is formed. The slot will thus be divided into three portions, with the central portion in the flat top and the angle of the side portions defined by the top angle of said cone. The nozzle is provided with a through passage from its rear end up to the slotted aperture, allowing a material under pressure to be forced through the nozzle from its rear end and out through its slotted aperture.

The three-part profile of the aperture causes the material jet forced out through the nozzle to want to split into three smaller jets. If the pressure of the material lies below a certain level, the jets will, however, be kept together by the surface tension, despite the corners between the side portions and the central portion. Dependent upon the material to be used and the reological properties thereof, different spraying pressures and angles are suitable. Most of the material is ejected through the central portion, which is open in the same direction as said through passage, whereby said surface tension primarily causes the two smaller side jets to be deflected towards the centre jet. As a consequence, the jet will have a comparatively even width over a prolonged distance, providing a wide useful application distance range. As most of the material is extruded through the central portion, the coating profile will furthermore have the greatest thickness at the centre, i.e. at the joint where the material is required.

DETAILED DESCRIPTION OF A PREFERRED EMBODIMENT

The invention relates to a nozzle for the application of a sealant or a glue, e.g. onto joints of car bodies. Two general problems with the prior art has been discussed; sensitivity to variations in the application distance, and distribution of the material on the coated surface. The present invention will solve both these problems through a nozzle, the aperture of which opens in a slot having a central portion, functioning to release most of the material straight ahead. The nozzle according to the present invention further exhibits side portions of said slot, functioning to release material towards the sides. Said central portion and side portions may be rectilinear or curved. Adjacent rectilinear portions are separated by corners, whereas adjacent curved portions are separated by having different radii of curvature and/or centres of curvature. Irrespective of the specific design, the basic idea behind the present invention is that material being released from adjacent portions of said slot will be kept together by the surface tension in the material, even though the material is released at different exit angles.

A preferred embodiment, exhibiting a three-part slot, will be described below with reference to FIGS. 3*a* to 3*d*.

Figure 1:
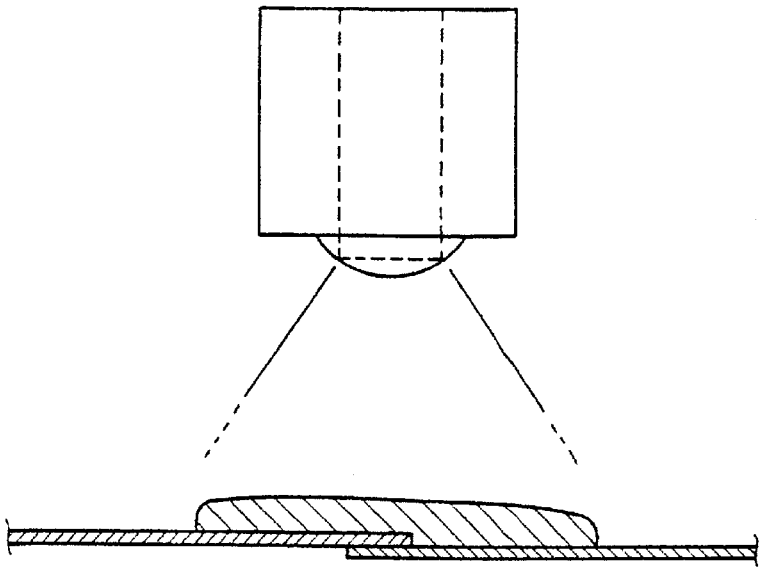
FIG. 1 PRIOR ART
FIG. 1 shows a prior art nozzle generating a jet in the form of a flat cone.
Figure 2:
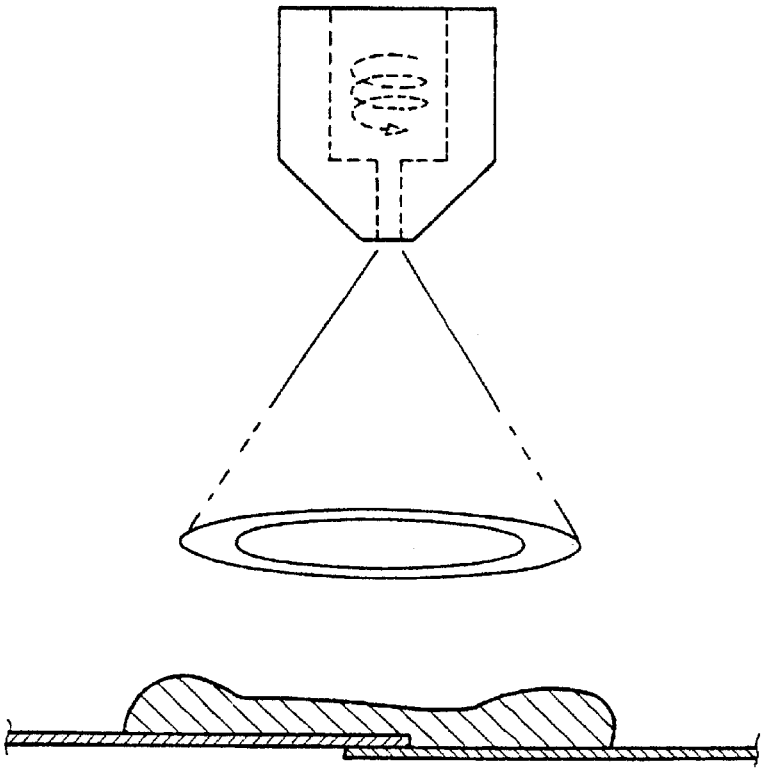
FIG. 2 PRIOR ART
FIG. 2 shows a prior art nozzle creating a jet in the form of a hollow cone.
Figure 3A:
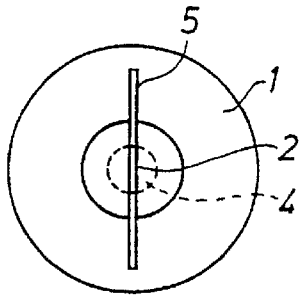
FIGS. 3*a*, 3*b* and 3*c* show various views of an embodiment of the invention.
Figure 3B:
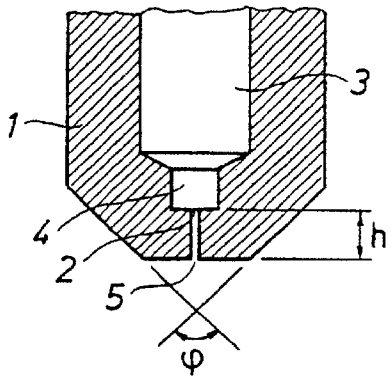
Figure 3C:
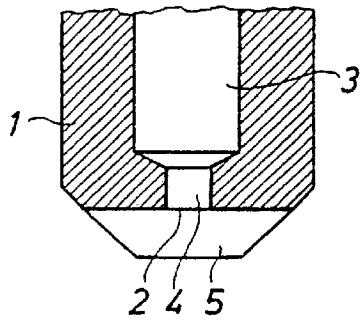

FIGS. 3*a* to 3*c* show a preferred embodiment of the nozzle 1 according to the invention, in three different views. FIG. 3*a* shows the nozzle from below, i.e. its front opening 2 is directed outwards from the paper sheet. FIG. 3*a* reveals that the nozzle 1 has a substantially circular longitudinal cross-section; this is however only to be regarded as an example, as this part of the nozzle shape is of no decisive importance for the invention. Thus, this cross-section could just as well be rectangular. In FIG. 3*b*, the nozzle 1 is shown in a cross-sectional side view. The rear end of the nozzle 1, the upper portion in FIG. 3*b*, is not shown in full, as this portion of the nozzle is of no decisive importance for the invention. The front section of the nozzle 1, the lower portion in FIG. 3*b*, has the shape of a truncated cone. In another embodiment, having a rectangular cross-section, this cone would rather be a pyramid. The cone top angle $\phi$ is indicated in the figure. A passage 3, through which material is intended to flow, runs through the entire nozzle 1 from its rear end to the aperture 2 at its front end. The passage 3 is relatively wide and preferably cylindrical. In a preferred embodiment, as shown in the figure, the passage 3 has a narrower portion 4 just before the aperture 2, thereby causing an increase in the velocity of the material to be applied. It can also be gathered from the figure that the wide passage 3 terminates at the aperture 2, a certain distance h from the flat portion of the front end.

As may be gathered from FIGS. 3*a* to 3*c*, the aperture 2 opens into a slot 5, formed in the front end of the nozzle 1. The slot 5 is formed in the flat portion of the front end, with a constant depth h, that is down to the aperture 2. The slot 5 runs across the nozzle 1, whereby the slot 5 will also encompass two diametrically opposite portions of the conical surface. The slot 5 is cut down to the aperture 2 of the passage 3, allowing a free flow of material through the nozzle 1, from its rear end and out through the slot 5 at its front end.

FIG. 3*c* shows the nozzle 1 and its slot 5 in a cross-sectional view from another angle. In this figure, the slot 5 runs in the plane of the paper sheet. It will be evident from FIGS. 3*a* to 3*c*, that the aperture 2 is substantially more narrow than the passage 3, causing a large increase in speed as the material is pressed through the nozzle towards its aperture 2. As a result of this speed increase, the material will partially fill out the slot 5 before leaving the nozzle 1.

Figure 3D:
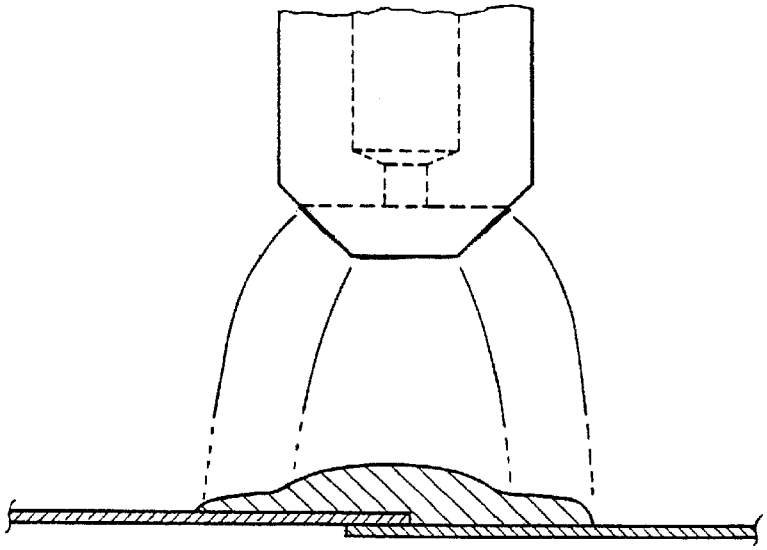
FIG. 3*d* shows a nozzle according to the present invention creating a jet with an enlarged working range.

From when the slot 5 has been filled with material, there are substantially three routes by which to leave the nozzle, straight ahead through the flat front end of the nozzle, or through one of the two angled straight sides. In the preferred embodiment, the major portion of the material will pass out through the flat front end, for two reasons; partly because the end straight ahead is in line with the passage 3, not necessitating any directional change of the material, and partly because the width of the front flat end is larger than the width of the respective side portions. Ideally, the discussed design should cause the material to be ejected in three separate jets, one straight ahead and two obliquely towards the sides. Through a suitable shape of the nozzle 1, in particular the size of the cone angle $\phi$ and the shape of the slot 5, and an adaptation of that pressure at which the material is pressed through the nozzle, the three jets are however brought to converge due to the surface tension. This is illustrated in FIG. 3*d*, in which the nozzle is seen from the same angle as in FIG. 3*c*. As most of the material will pass through the flat front end, the two jets passing through the angled side portions will be deflected towards the centre jet by the forces of surface tension. The result will be, as illustrated in FIG. 3*d*, that the jet will be less conical than with prior art nozzles, allowing an enlarged working range.

FIG. 3*d* further illustrates the profile of the coating after having applied the material onto the substrate. The profile of the surface coating is clearly divided into three parts, as a consequence of three jets, even if held together, being used. It is furthermore evident, that the thickest portion of the coating is provided at the centre. This secures a good sealing of the joint and a high strength of the sealant coating.

The nozzle is particularly suitable for the application of sealant onto joints of car bodies. The nozzle provides a well-composed joint whilst reducing the consumption of sealant compared to prior art nozzles. Consequently, the nozzle is advantageous from a design aspect as well as an economical aspect.

In a preferred embodiment, the cone angle is $\phi=90°$, whereby the flat front end of the truncated cone has a diameter of 4 mm. In such an embodiment, the slot 2 will have a length of 8.5 mm and a width of 0.45 mm. Such an embodiment is specifically adapted to one type of material, and with another type of material, the dimensions may need to be modified.

What is claimed is:

1. A nozzle intended for the application of a liquid material onto an object to coat the object, which at a front end thereof has an aperture opening into a slot, which slot has a central outlet portion functioning to release most of the liquid material straight ahead, and laterally directed side outlet portions, wherein said slot has a straight base at said aperture such that said aperture does not extend into said slot, opposing said central outlet portion, where said side outlet portions extend between said straight base and said central outlet portion, which side outlet portions each distribute released liquid material in a jet with a relatively even width and at an angle to the liquid material released from said central outlet portion, where said front end of the nozzle is shaped like a truncated cone in which said slot is formed, said cone having a flat axial end and an offset portion adjacent said flat axial end, said central outlet portion of said slot formed in said flat axial end, and each said side outlet portion of said slot formed in said offset such that each side outlet portion is offset relative to said central outlet portion of said slot.

2. The nozzle according to claim 1, characterized in that said central outlet portion of said slot is straight and said side outlet portions of said slot are also straight and disposed at an angle relative to said central outlet portion of said slot.

3. The nozzle according to claim 1, comprising a hollow nozzle body having a liquid material passage formed therein that extends from adjacent a rear end thereof and which is in fluid flow communication with said aperture adjacent the front end of the nozzle.

4. The nozzle according to claim 3, wherein said slot adjacent said straight base is narrower than said liquid material passage adjacent said aperture and said liquid material (passage terminates at said aperture, at a certain distance inside said front end, where it is met by said slot, thereby causing a velocity increase in the liquid material being passing through said passage, through said aperture, and into said slot.

5. The nozzle according to claim 4, characterized in that said liquid material passage has a narrower portion upstream of said aperture.

6. The nozzle according to claim 5, characterised in that said truncated vane has a top angle of 90°.

7. The nozzle according to claim 6, characterized in that said central outlet portion of said slot is longer than said side outlet portions of said slot.

8. The nozzle according to claim 7 wherein the nozzle is adapted to apply the liquid material onto an object that comprises a joint of a car body.

9. The nozzle according to claim 8 wherein the liquid material comprises glue and the nozzle is adapted to apply liquid glue onto a car body joint.

10. A nozzle intended for the application of a liquid material in a nonuniform distribution pattern, which at a front end thereof has an aperture opening into a slot, which slot has a central portion with a first length, functioning to release most of the liquid material straight ahead, and laterally directed side portions, wherein said slot has a straight base at said aperture extending straight through the nozzle, said straight base opposing said central portion and having a second length larger than said first length, and where said side portions extend between the ends of said straight base and the ends of said central portion, respectively, thereby facing obliquely forward, which side portions are functioning to distribute released liquid material alongside and overlapping said straight ahead released liquid material, where said front end is shaped like a truncated cone having a flat top, in which said slot is formed, said slot being divided into three outlet portions having a pair of said side outlet portions spaced apart by said central outlet portion with said side outlet portions being rectilinear and disposed at angle corresponding to a top angle of said cone, and where said aperture has a nonspherical distal end.

11. The nozzle according to claim 10 wherein said nonspherical distal end of said aperture is straight.

12. A nozzle for the application of fluid glue in a non-fan-shaped distribution pattern onto an object, wherein the nozzle has an aperture adjacent a frustoconically shaped front end thereof, said aperture opening into a narrower slot, and which said slot has a central outlet portion functioning to release fluid glue straight ahead, and offset side outlet portions functioning to distribute the remainder of the fluid glue being released from the nozzle in jets that each release fluid glue alongside and at an angle relative to the straight ahead released fluid glue.

13. A nozzle intended for the application of a liquid coating onto an object in a non-uniform application pattern, which at a front end thereof has passageway in the nozzle opening into a narrower planar slot, which slot has a central outlet portion with a first length, functioning to release most of the liquid coating from the front end of the nozzle, and a laterally directed side outlet portion disposed on either side of said central outlet portion, wherein said slot has a generally rectangular cross section at a junction where said slot meets said passageway, opposing said central outlet portion and having a second length greater than said first length, and where said side outlet portions extend between said straight base and said central outlet portion, which side outlet portions each release liquid coating in a jet, where said front end is shaped like a truncated cone with a flat top, in which said slot is formed, said slot being divided into three portions, with said central outlet portion disposed in said flat top and said side outlet portions disposed at an angle corresponding to a top angle of said cone, and where said passageway terminates in a substantially straight distal end such that said passageway does not extend into said slot.

14. A nozzle for the application of a fluid sealant onto an object to coat the object, wherein the nozzle has an aperture adjacent a front end thereof, opening into a slot defined by a pair of spaced apart, parallel, and flat fluid sealant guides at the front end thereof, and which said slot has a central outlet portion functioning to release most of the fluid sealant from the nozzle straight ahead, and laterally directed side outlet portions angled relative to said central outlet portion and functioning to release the rest of the fluid sealant from the nozzle in jets that each have a relatively even width and disposed alongside the fluid sealant released straight ahead.

15. A nozzle for applying fluid sealant or glue in a non-uniform distribution pattern onto a car body, the nozzle comprising a body with a frustoconical end, a slot-shaped discharge opening in the frustoconical end, a fluid passage in fluid flow communication with the slot-shaped discharge opening, and a restriction in the fluid passage disposed adjacent the slot-shaped discharge opening where said fluid passage defines an aperture opening into the slot-shaped discharge opening that has a straight distal end.

16. The nozzle according to claim 15 wherein the slot-shaped discharge opening is defined by a pair of spaced apart and parallel sidewalls that each have an inclined edge at one end and an inclined edge at another end.

17. The nozzle according to claim 15 wherein the fluid passage has a width and the restriction comprises a second passage disposed downstream of the fluid passage and upstream of the slot-shaped discharge opening wherein the second passage has a width that is less than the width than the fluid passage.

18. The nozzle according to claim 17 wherein the width of the fluid passage and the width of the second fluid passage are both greater than the width of the slot-shaped discharge opening.

19. The nozzle according to claim 15 wherein the slot-shaped discharge opening is defined by a pair of spaced apart and parallel sidewalls that each have an inclined edge at one end and an inclined edge at another end, wherein the discharge opening is adapted to discharge the fluid sealant or glue from the slot-shaped opening with a central stream of the fluid sealant or glue that is discharged generally parallel to a longitudinal axis of the nozzle body and a pair of side streams of the fluid sealant or glue with one of the side streams being discharged along one pair of the inclined edges at an angle relative to the longitudinal axis and another one of side streams being discharged along the other pair of the inclined edges at an angle relative to the longitudinal axis with both side streams remaining connected with the central stream, and wherein the central stream results in more fluid sealant or glue being applied to the car body than either one of the side streams.

20. The nozzle according to claim 19 wherein when the nozzle is adapted to be moved relative to the car body in order to discharge a layer of the fluid sealant or glue onto the car body that is thicker in its middle than along its sides.

21. A nozzle for application of liquid sealant or glue onto an object comprising:

a nozzle body having a passageway disposed therein that terminates in an aperture that delivers the liquid sealant or glue into a space in between a pair of substantially parallel and straight guides that define a substantially planar discharge slot; and wherein said guides are constructed and arranged to cooperate with the liquid sealant or glue being applied so as to separate the liquid sealant or glue into a plurality of streams discharged from said nozzle body, with one of the plurality of streams discharged from one portion of said discharge slot in a direction generally parallel to a longitudinal axis of said nozzle body and another one of the plurality of streams being discharged from another portion of said discharge slot alongside said one of the plurality of streams and at angle relative to said longitudinal axis such that a layer of the liquid sealant or glue applied is thicker where said one of the plurality of streams contacts the object than where said another one of the plurality of streams contacts the object.

22. The nozzle according to claim 21 wherein said discharge slot is narrower than said passageway and said comprises a generally cylindrical bore wherein each one of said guides comprises a flat surface that comes into contact with liquid sealant or glue exiting from aperature into said discharge slot and each one of said guides further comprises a generally straight axial outer edge disposed between a pair of offset side edges that extend therefrom such that said axial edges of said guides direct liquid sealant or glue into a first one of said one of the plurality of streams, with said offset side edges of said guides arranged in a first pair of adjacent side edges that direct liquid sealant or glue into a second one of the plurality of streams and a second pair of adjacent side edges that direct liquid sealant or glue into a third one of the plurality of streams.

23. The nozzle according to claim 22 wherein said guides define a distal end of said nozzle body that has a generally frustoconical shape.

* * * * *